US007384188B2

(12) United States Patent
Waggoner et al.

(10) Patent No.: US 7,384,188 B2
(45) Date of Patent: Jun. 10, 2008

(54) MIXING LID HAVING INNER AND OUTER PADDLES FOR MIXING A LIQUID MIXTURE IN A CONTAINER

(75) Inventors: Breck A. Waggoner, Canton, MI (US); David B. Stott, Canton, MI (US)

(73) Assignee: Better Way Tool Company, Plymouth, MI (US)

( * ) Notice: Subject to any disclaimer, the term of this patent is extended or adjusted under 35 U.S.C. 154(b) by 0 days.

(21) Appl. No.: 11/585,547

(22) Filed: Oct. 24, 2006

(65) Prior Publication Data

US 2008/0094938 A1 Apr. 24, 2008

(51) Int. Cl.
*B01F 7/20* (2006.01)

(52) U.S. Cl. ..... 366/247; 366/328.2; 366/329.1; 366/605

(58) Field of Classification Search ..... 366/242–252, 366/605, 329.1, 329.2, 328.2
See application file for complete search history.

(56) References Cited

U.S. PATENT DOCUMENTS

| | | | | | |
|---|---|---|---|---|---|
| 565,007 | A * | 8/1896 | Lawton | 366/328.2 |
| 1,698,402 | A * | 1/1929 | Harris | 366/247 |
| 2,027,297 | A * | 1/1936 | Tramposch | 366/254 |
| 2,269,736 | A * | 1/1942 | Rogers | 222/545 |
| 2,392,731 | A * | 1/1946 | Fox | 366/327.1 |
| 2,585,334 | A * | 2/1952 | McCauley | 220/326 |
| 3,021,118 | A * | 2/1962 | Dedoes | 366/247 |
| 3,041,052 | A * | 6/1962 | Dedoes | 366/247 |
| 3,175,808 | A * | 3/1965 | Dedoes | 366/280 |
| 3,704,007 | A | 11/1972 | Kroeger | |
| 4,407,584 | A * | 10/1983 | Boudin et al. | 366/279 |
| 4,422,770 | A | 12/1983 | Geible | |
| 4,926,390 | A * | 5/1990 | Murzsa | 366/249 |
| 5,094,543 | A * | 3/1992 | Mursa | 366/247 |
| D327,015 | S | 6/1992 | Stallings | |
| 5,199,788 | A * | 4/1993 | Stallings | 366/247 |
| 5,251,979 | A * | 10/1993 | Larsen | 366/248 |
| 5,358,153 | A * | 10/1994 | Caldwell et al. | 222/505 |
| 5,407,270 | A * | 4/1995 | Barile et al. | 366/247 |
| 5,676,463 | A * | 10/1997 | Larsen | 366/251 |
| 5,857,772 | A | 1/1999 | Washington | |
| 6,419,385 | B1 * | 7/2002 | Walls | 366/247 |
| 6,670,171 | B2 * | 12/2003 | Carll | 435/289.1 |
| 6,877,891 | B2 | 4/2005 | Hu | |
| 6,896,402 | B2 * | 5/2005 | Desinano | 366/197 |

FOREIGN PATENT DOCUMENTS

| | | | |
|---|---|---|---|
| GB | 1387695 | * | 3/1975 |

* cited by examiner

*Primary Examiner*—Charles E. Cooley
(74) *Attorney, Agent, or Firm*—Warn Partners, P.C.

(57) ABSTRACT

A mixing and dispensing apparatus having a lid with an opening extending from a first side to a second side of said lid. A shaft is rotatably positioned through said lid so that a first end of the shaft terminates on the first side of said lid and a second end of the shaft terminates on the second side of the lid. Two or more inner paddles are connected to the shaft and two or more outer paddles are connected to the shaft. The outer paddles extend further away from the shaft than the inner paddles.

27 Claims, 2 Drawing Sheets

MIXING LID HAVING INNER AND OUTER PADDLES FOR MIXING A LIQUID MIXTURE IN A CONTAINER

FIELD OF THE INVENTION

The present invention relates to a mixing apparatus integrated with a lid for a container.

BACKGROUND OF THE INVENTION

In the construction and home improvement industry there are several materials that often require mixing prior to and occasionally during application. Paints, varnishes, concrete, and stains are common types of materials that require pre-mixing. One of the problems that is often encountered has to do with mixing these materials in their container without spilling or dripping the liquids from the container to the outside environment. For example with liquids such as paint, a traditional way of mixing has always been to use a paint stick, typically a wooden stick that is used to hand mix the paint in the can. When the user is done mixing they must try to move the stick out of the paint can without dripping and then dispose of the stick or store it for future use. Not only can this be a messy process, it does not always adequately mix the paints prior to application.

Power and crank mixers have been developed, however, they often lack ability to thoroughly mix the liquids in a closed environment. Additionally, such power and crank mixers must still be removed in such a manner as to not spill or leak material to the outside of the container.

The difficulties of mixing liquids in containers, is not just limited to the construction and home improvement industry. This is also common in the food industry where liquid or semi-solid foods must be mixed in containers prior to being dispensed. This is more common place in a commercial type of setting where large volumes of foods are being mixed. Therefore, there is a need in virtually any type of field involving the mixing of liquids in containers for an apparatus that will thoroughly mix the liquids as well as eliminate the possibility of spilling that can result when a mixing tool is removed from the container.

SUMMARY OF THE INVENTION

A mixing and dispensing apparatus having a lid with an opening extending from a first side to a second side of said lid. A shaft is rotatably positioned through said lid so that a first end of the shaft terminates on the first side of said lid and a second end of the shaft terminates on the second side of the lid. Two or more inner paddles are connected to the shaft and two or more outer paddles are connected to the shaft. The outer paddles extend further away from the shaft than the inner paddles.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
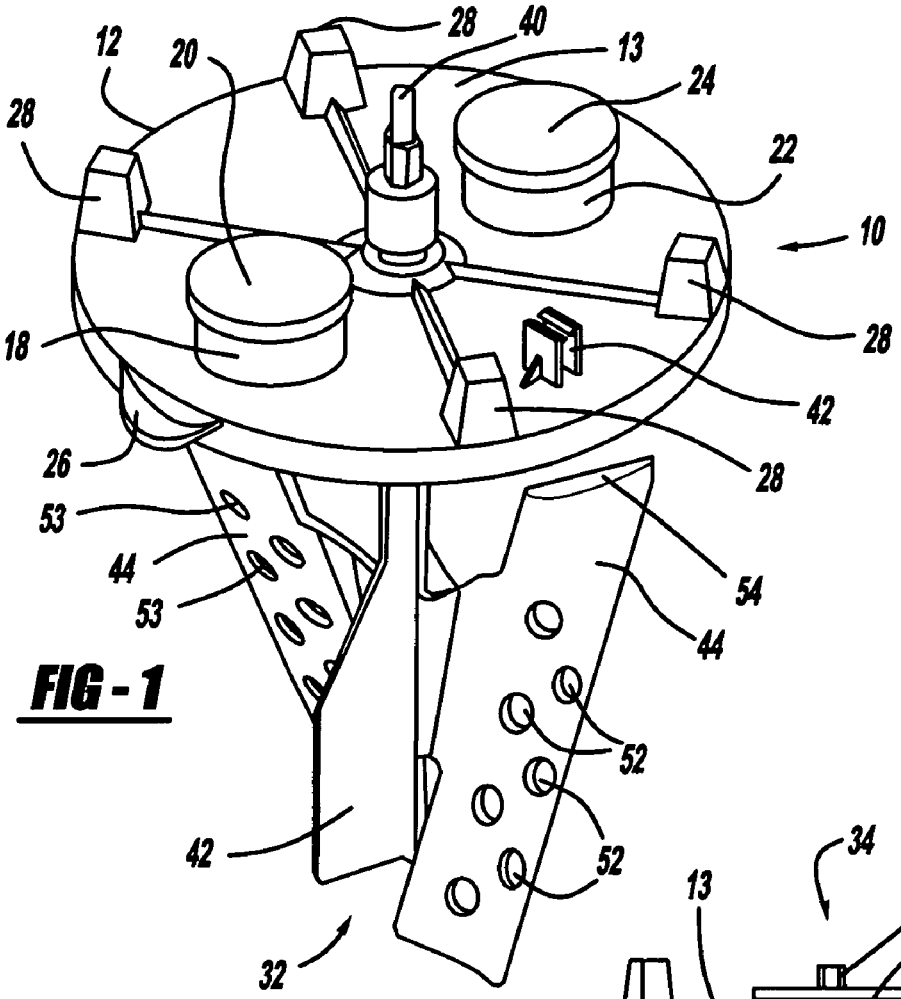
FIG. 1 is a side perspective view of the mixing and dispensing apparatus.
Figure 2:
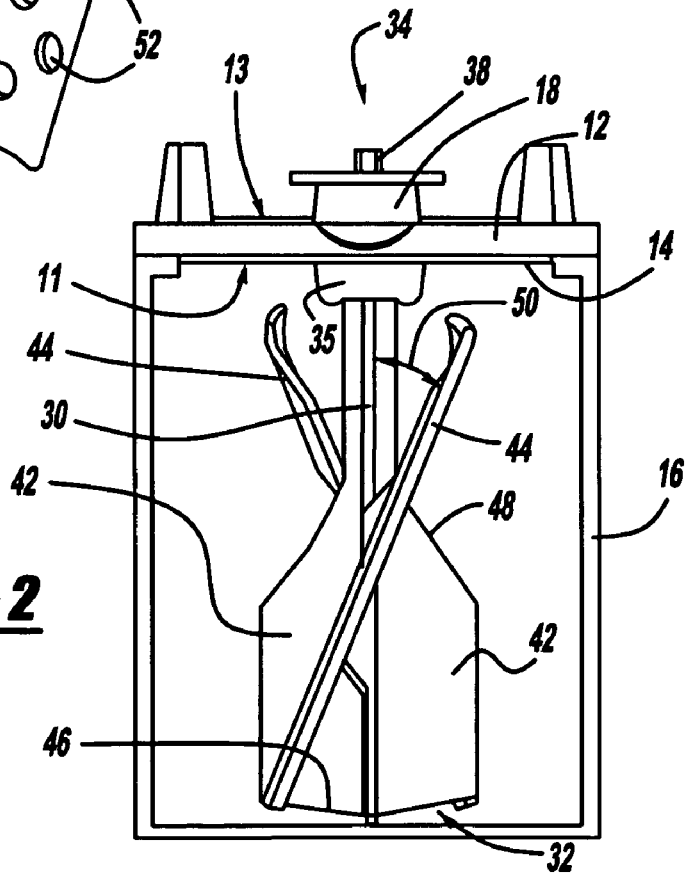
FIG. 2 is a side plan view of the mixing and dispensing apparatus.
Figure 3:
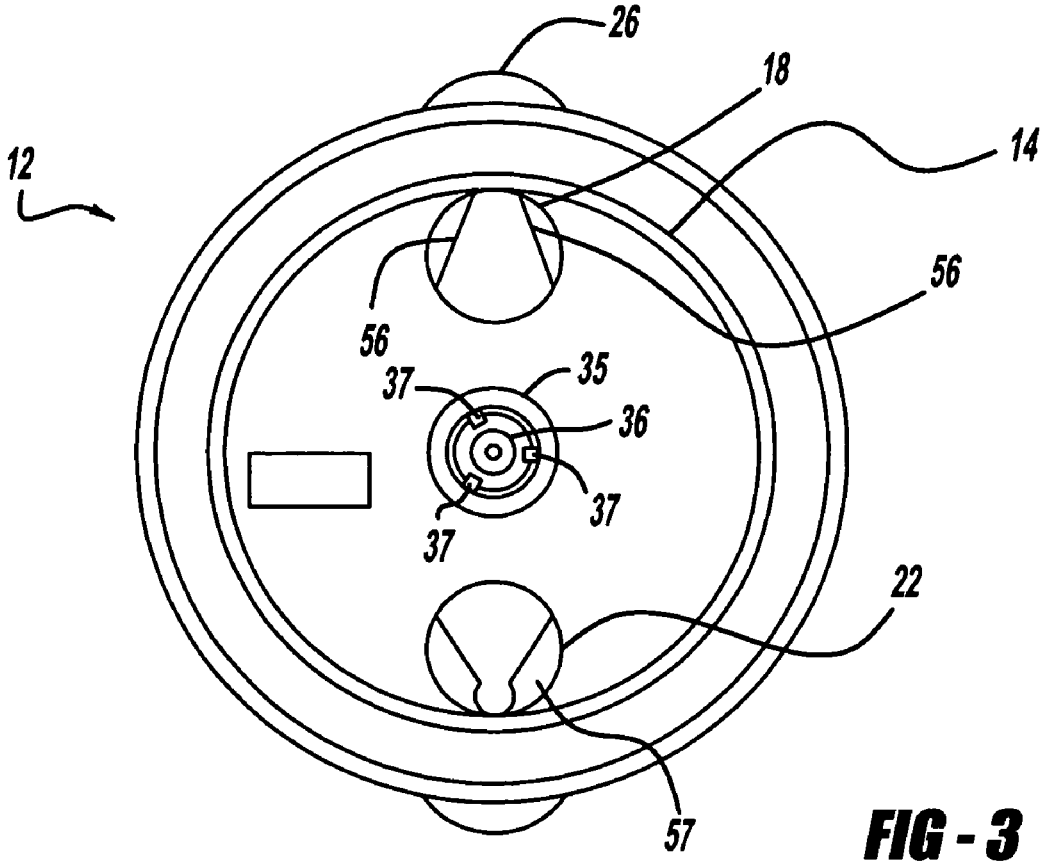
FIG. 3 is a bottom plan view of the lid with the shaft and paddles removed.
Figure 4:
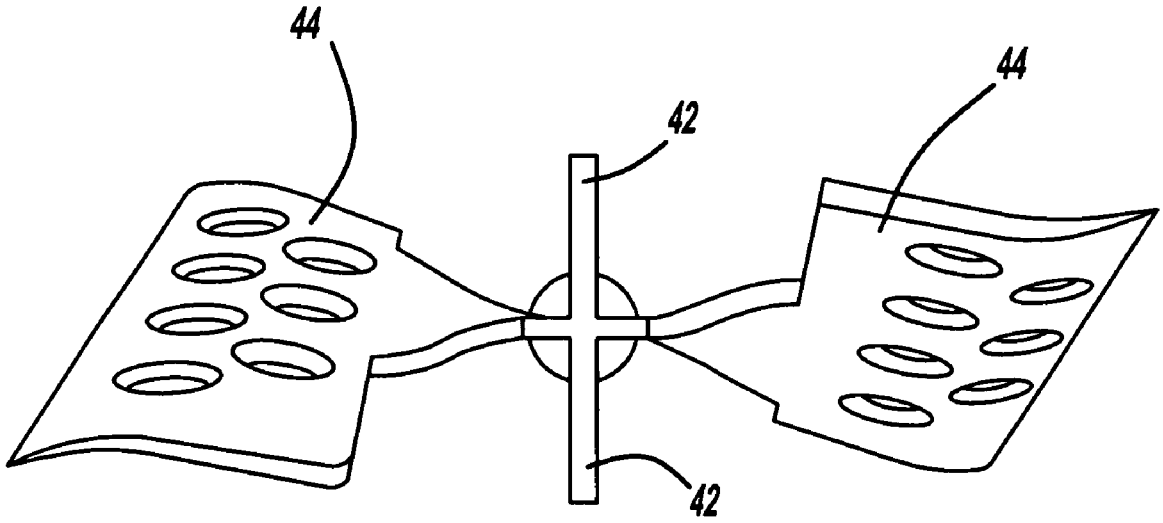
FIG. 4 depicts a plan end view of the mixing and dispensing apparatus.

Referring generally to all the Figures and FIGS. 1 and 2 in particular show a mixing and dispensing apparatus 10 is generally shown. The apparatus 10 has a lid 12 having a seal 14 for connecting to a can 16 such as a paint can or other type of container. The can 16 has a hollow interior with a bottom opposite the opening, where the lid 12 is placed. The seal 14 ensures that a seal can be made between the lid 12 and the can 16. The seal 14 can have any type of configuration suitable for connecting the lid 12 to the can 16. The seal 14 is particularly important because the lid 12 is intended to stay in place until the contents of the can 16 are completely used up. For example in an application where the apparatus 10 is being used with a paint can it is sometimes necessary to store the paint for months and sometimes even years before the paint is completely used. Therefore the seal 14 will prevent the liquid contents inside of the can 16 from drying out.

The lid 12 has a first side 11 facing the interior of the can and a second side 13 forming the top of the can 16. A pour opening 18 that can be sealed by a cap 20 extends through said lid 12. A vent opening 22 is also provided and has a cap 24 which can be removed to vent the lid 12 while paint is poured out the can 16. The vent opening 20, although not required is desirable because the seal 14 of the lid 12 prevents pressure relief inside of the can 16 when liquid is being poured through the pour opening 18. Adjacent the pour opening 18 is a spout 26 that functions as an anti-drip mechanism to prevent paint on the top of the lid 12 from dripping down the side of the can 16. The presence of a pour spout 26 on the lid 16 allows the mixing and dispensing apparatus 10 to remain on the can 16 until the entire liquid contents are used up. This eliminates the need to remove the inner paddles 42 and outer paddles 44 from the liquid prior to the can 16 being emptied. The pour opening 18 has a flange 56 and the vent opening 22 has a flange 57. The flange 56 functions to help control the path of flow of liquid through the pour opening 18. The flange 57 of the vent opening 22 can be shaped to clasp a tube for a dispenser or paint application apparatus, such as a paint sprayer or power paint roller. The flanges 56, 57 also function to draw liquid back down through the opening and into the can 16 when pouring of the contents of the can is complete.

The lid 12 also has a number of towers 28 extending from the second side 13 of the lid 12. As shown, there are four towers, however, it is possible for there to be a fewer or greater number of towers. For example, a single tower can be used that circumscribes most or all of the second side 13 of the lid 12. The towers 28 provide a way of stacking cans on top of cans 16 that have a mixing and dispensing apparatus 10 attached. Depending upon the size of the can 16 a greater or fewer number of towers 28 will be needed. In another aspect of the invention the towers 28 can have holders configured to grab and hold a mixer shaft 30 when the mixing and dispensing apparatus 10 is disassembled.

When the mixing and dispensing apparatus 10 is assembled it will extend through the lid 12 so that the mixer shaft 30 that has a first end 32 that terminates on the first side 11 of the lid 12, and a second end 34 that terminates on the second side 13 of the lid 12. The mixer shaft 30 is rotatably connected to the lid 12 and can be held in place with and extension 35 and chamfered ring 36 that prevents the shaft 30 from moving axially during rotation. The chamfered ring 36 is rotatably held within the extension by tangs 37 extending from the surface of the extension 35. When the apparatus 10 is assembled the retention feature 35 allows the shaft 30 to be picked up with the lid 12. The chamfered ring 36 can also act as a seal to prevent paint from exiting the lid 12 or a separate seal can be included between the chamfered ring 36 and the lid 12.

The second end 34 of the mixer shaft 30 has a universal attachment 38 such as a hexagonal connection or other suitable attachment. The universal attachment 38 can be connected using an adapter tool 40 that is connectable to the universal attachment 38 on one end and at a second end to an actuator (not shown). The actuator that can be connected to the adapter tool can be any type of actuator including a drill, hand crank, kitchen hand mixer or some other type of motorized actuator that is suitable for providing a sufficient amount of torque to the mixing and dispensing apparatus 10. The adapter tool 40 can be removed from the universal attachment 38 when not in use. The adapter tool 40 can be stored on a holder 42 attached to or integrally formed on the second side of the lid 12. The holder 42 can be a snap fit type of attachment or it can be a molded recess shaped to grasp the adapter tool 40. It is also possible for the holder 42 to be a closed container or compartment that holds the adapter tool 40 when removed. Additionally, the adapter tool 40 allows for the connection of various types of actuators. The use of the adapter tool 40 for attaching to the universal attachment 38 also allows the second end 34 of the mixer shaft 30 to be positioned below the height of the towers 28. Furthermore the adaptor tool 40 eliminates the need to constantly chucking and un-chucking an actuator from the shaft 30. Therefore, other canisters or cans can be stacked on the towers 28 without interference from the universal attachment 38 or adapter tool 40.

On the second side 13 of the lid 12 the shaft 30 has inner paddles 42 and outer paddles 44 connected to the shaft 30. The inner paddles 42 have a wide base 46 with an angled surface 48 that extends toward the shaft 30. Thus, the width of the inner paddle at the wide base 46 is substantially reduced before the inner paddle 42 extends above the height of the outer paddles 44. The outer paddles 44 extend further away from the shaft 30 than the inner paddles 42. The outer paddles 44 are set at an angle A with respect to the inner paddles and have a pitch angle 50 that serves to cause liquids to flow upward along the surface of the paddle as the shaft 30 rotates. Additionally, the outer paddles have holes 52, 53 that aid in breaking apart semi-solids in the liquid as the shaft 30 rotates. The holes 52, 53 are positioned in a predetermined pattern and are disposed through outer paddles 44 at an angle in order to maximize the mixing process. For example liquids that are sheared through one the holes 53 will be sheared by two holes 52 on the next paddle during rotation of the shaft 30; then four holes 53 upon full rotation of the shaft 30. Furthermore, the holes 52 and 53 are aligned so that flow of the liquid during rotation is upward and outward at an angle across the outer paddles 44. At the top of the outer paddles 44 is a deflector 54 that moves liquid into the center of the can 16 and then down to fill the void left by the movement of liquid from the inner paddles 42. In order to keep the liquid flowing upward along the outer paddles 44, the outer paddles 44 have a concave shape that prevents liquids from flying off the outer paddles 44 and onto the sides of the can 16.

As the shaft 30 rotates the inner paddles 42 will rotate near the bottom of the can 16. This causes liquid at the bottom of the can to form a vortex that extends upward and expands toward the sides of the can 16. The vortex created by the inner paddles is disrupted by the outer paddles 44 which whip fluids from the vortex created by the inner paddles 42 and break apart any semi-sold materials using the outer paddles 44 in combination with the holes 52, 53. The outer paddles 44 as they spin will also create a vortex and cause liquids to be drawn upward with respect to the can 16 along the face of the paddles. When the liquid reaches the top of the outer paddles 44 the deflectors 54 will direct the flow of fluids back downward toward the bottom center of the can. This creates a circular type of current where there is a central vortex created by the inner paddles 42 and a circular type of current created by the outer paddles 44 which directs fluid back down to the bottom of the can 16 where the inner paddles 42 will again take up the liquid and move it back through the process. When an actuator such as a drill or other type of motor is connected to the shaft 30 the liquid inside of the can 16 can be mixed at a moderate or high rate of speed compared to other methods of mixing such as using a paint stick for example. The end result is that the apparatus 10 allows liquids in the can 16 to be mixed thoroughly in a short amount of time with no mess.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A mixing and dispensing apparatus comprising:

a lid having an opening extending through said lid from a first side to a second side;

a shaft rotatably positioned through said lid;

two or more inner paddles connected to said shaft on said first side of said lid;

two or more outer paddles connected to said shaft on said first side of said lid, wherein said outer paddles extend further away from said shaft than said inner paddles; and wherein said two or more outer paddles are concave shaped and said two or more paddles have a pitched angle relative to a longitudinal axis of said shaft, wherein each said pitch angle draws fluid upward along the surface of each of said two or more outer paddles.

2. The mixing and dispensing apparatus of claim 1 wherein said two or more outer paddles or said two or more inner paddles each have one or more holes.

3. The mixing and dispensing apparatus of claim 1 further comprising one or more towers formed on said second side of said lid.

4. The mixing and dispensing apparatus of claim 1 further comprising a universal attachment formed on an end of said shaft that extends past said second side of said lid.

5. The mixing apparatus of claim 1 further comprising a retaining feature on said lid with a chamfered ring connected to said shaft and rotatably contained in said retaining feature.

6. A mixing and dispensing apparatus comprising:

a lid having an opening extending through said lid from a first side to a second side;

a shaft rotatable positioned through said lid;

two or more inner paddles connected to said shaft on said first side of said lid;

two or more outer paddles connected to said shaft on said first side of said lid, wherein said outer paddles extend further away from said shaft than said inner paddles;

one or more towers formed on said second side of said lid; and one or more holders formed on said one or more towers to hold said shaft when said mixing and dispensing apparatus is disassembled.

7. The mixing and dispensing apparatus of claim 6, wherein said two or more outer paddles or said two or more inner paddles each have one or more holes.

8. The mixing and dispensing apparatus of claim 6 further comprising a universal attachment formed on an end of said shaft that extends past said second side of said lid.

9. The mixing and dispensing apparatus of claim 6 further comprising a retaining feature on said lid with a chamfered ring connected to said shaft and operably connected to said retaining feature.

10. The mixing and dispensing apparatus of claim 6, wherein said two or more outer paddles are concave shaped.

11. A mixing and dispensing apparatus comprising:

a lid having an opening extending through said lid from a first side to a second side;

a shaft rotatable positioned through said lid;

two or more inner paddles connected to said shaft on said first side of said lid;

two or more outer paddles connected to said shaft on said first side of said lid, wherein said outer paddles extend further away from said shaft than said inner paddles;

a universal attachment formed on an end of said shaft that extends past said second side of said lid;

an adapter tool removably connected to said universal attachment on one side of said adapter tool and removably connected to an actuator on a second side of said adapter tool; and a holder formed on the second side of said lid for storing said attachment tool.

12. The mixing and dispensing apparatus of claim 11 wherein said actuator is one selected from the group comprising a drill, hand crank, or a kitchen hand mixer.

13. The mixing and dispensing apparatus of claim 11, wherein said two or more outer paddles and said two or more inner paddles each have one or more holes.

14. The mixing and dispensing apparatus of claim 11, wherein said two or more outer paddles have a pitch angle relative to a longitudinal axis of said shaft, wherein each said pitch angle draws fluid upward along the surface of each of said two or more outer paddles.

15. The mixing and dispensing apparatus of claim 11, wherein said two or more outer paddles are concave shaped.

16. A mixing and dispensing apparatus comprising:

a lid having an opening extending through said lid from a first side to a second side of said lid;

a shaft rotatably positioned through said lid, wherein said shaft terminates at a first end on said first side of said lid and at a second end on said second side of said lid;

two or more inner paddles connected to said shaft on said first side of said lid;

two or more outer paddles connected to said shaft on said first side of said lid, wherein said outer paddles extend further away from said shaft and said inner paddles;

three or more towers formed on said second side of said lid;

a universal attachment formed on said second end of said shaft; and a vent opening extending through said lid from said first side to said second side.

17. The mixing and dispensing apparatus of claim 16 further comprising one or more holders formed on said three or more towers to hold said shaft when said mixing and dispensing apparatus is disassembled.

18. The mixing and dispensing apparatus of claim 16 further comprising an adapter tool removably connected to said universal attachment on one side of said adapter tool and removably connected to an actuator on a second side of said adapter tool; and a holder formed on said second side of said lid for storing said attachment tool below the height of said three or more towers.

19. The mixing and dispensing apparatus of claim 18 wherein said actuator is one selected from the group comprising a drill, hand crank, or a kitchen hand mixer.

20. The mixing and dispensing apparatus of claim 16 further comprising a retaining feature on said lid with a chamfered ring connected to said shaft and rotatably contained in said retaining feature.

21. The mixing and dispensing apparatus of claim 16 wherein said two or more outer paddles or said two or more inner paddles have one or more holes.

22. The mixing and dispensing apparatus of claim 16 wherein said two or more outer paddles have a pitch angle relative to a longitudinal axis of said shaft, wherein each said pitch angle draws fluid upward along the surface of said two or more outer paddles.

23. A mixer for mixing paint in a paint can comprising:

a paint can having a hollow interior with a bottom surface of said hollow interior and an opening to said hollow interior at a side opposite said bottom surface;

a lid having a seal formed on said first side for sealingly engaging said opening of said paint can and a pour opening in said lid extending from said first side of said lid to a second side of said lid, and a vent opening in said lid extending from said first side to said second side;

a shaft extending through said lid, wherein said shaft is rotatably connected to said lid;

two inner paddles connected to said shaft and positioned near said bottom surface of said hollow interior of said paint can, wherein said inner paddles are configured to draw paint from said bottom surface upward toward said opening of said paint can;

two outer paddles connected to said shaft above said two inner paddles, wherein said two outer paddles extend a greater distance away from said shaft then said two inner paddles;

one or more holes in said two outer paddles;

a universal attachment formed on an the of said shaft that extends past said second side of said lid; and one or more towers formed on said second side of said lid.

24. The mixer of claim 23 further comprising:

an adapter tool connectable to said universal attachment on one side of said adapter tool and an actuator on a second side of said adapter tool; and a holder formed on the second side of said lid for storing said attachment tool below the height of said one or more towers.

25. The mixer of claim 23 wherein said actuator is one selected from the group comprising of a drill, hank crank or a kitchen hand mixer.

26. The mixing and dispensing apparatus of claim 23 further comprising a retaining feature on said lid with a chamfered ring connected to said shaft and rotatably contained in said retaining feature.

27. The mixing and dispensing apparatus of claim 23 further comprising one or more holders formed on said one or more towers to hold said shaft when said mixing and dispensing apparatus is disassembled.

* * * * *